US007327313B2

(12) United States Patent
Hemmi et al.

(10) Patent No.: US 7,327,313 B2
(45) Date of Patent: Feb. 5, 2008

(54) TWO DIMENSIONAL QUANTIZATION METHOD FOR ARRAY BEAM SCANNING

(75) Inventors: Christian O. Hemmi, Plano, TX (US); Marc H. Mccullough, Plano, TX (US); Brian L. Ball, Trenton, TX (US)

(73) Assignee: Raytheon Company, Waltham, MA (US)

( * ) Notice: Subject to any disclaimer, the term of this patent is extended or adjusted under 35 U.S.C. 154(b) by 94 days.

(21) Appl. No.: 10/993,830

(22) Filed: Nov. 19, 2004

(65) Prior Publication Data

US 2006/0119510 A1 Jun. 8, 2006

(51) Int. Cl.
*H01Q 3/00* (2006.01)

(52) U.S. Cl. ..... 342/368

(58) Field of Classification Search ..... 342/368–377, 342/81

See application file for complete search history.

(56) References Cited

U.S. PATENT DOCUMENTS

| | | | | |
|---|---|---|---|---|
| 3,643,075 | A | 2/1972 | Hayes | 235/151 |
| 5,103,232 | A | 4/1992 | Chang et al. | 342/372 |
| 2006/0033659 | A1 * | 2/2006 | Strickland | 342/372 |

OTHER PUBLICATIONS

Xiangrong, Shu, et al "Experiments of Phase Control Null and Random Phase Quantization in Density Weighted Phase Arrays" IEEE, Radar 97 (Conf. Publ. No. 449), Oct. 14-16, 1997, pp. 501-505.*

Toshev, Alexander, "*Suppression of Phaser Quantization Lobes for Large Flat Phased Array Antennas*," Institute of Electrical and Electronics Engineers, ISBN: 0-7803-7330-8/02, pp. 208-211, Jun. 16, 2002.

Shen, Wenhui, et al., "*Eliminating Pointing Errors in Phased Arrays with Controlling Phase Errors by Random Series Method*," Institute of Electrical and Electronics Engineers, ISBN: 0-7803-8302-8/04, pp. 4120-4123, Jun. 2004.

Communication from the European Patent Office, European Search Report dated Feb. 1, 2006, for International Application No. 05256962.1-2220, 5 pages, Feb. 1, 2006.

(Continued)

*Primary Examiner*—Thomas H. Tarcza
*Assistant Examiner*—Nga X Nguyen
(74) *Attorney, Agent, or Firm*—Baker Botts L.L.P.

(57) ABSTRACT

According to one embodiment of the invention, a method of increasing a phase resolution of an array antenna, comprises providing an array antenna having a plurality of rows of antenna elements, each antenna element having a first phase resolution; for at least one row of the array antenna, positioning each of the antenna elements to one of first and second phases, the first and second phases separated by at least the first phase resolution; for the at least one row of the array antenna, a number of antenna elements positioned to the first phase is the product of a number of antenna elements in the at least one row of the array antenna and a desired row phase angle divided by the first phase resolution; and for the at least one row of the array antenna, a number of antenna elements positioned to the second phase is the number of elements in the at least one row of the array antenna minus the number of antenna elements in the at least one row positioned to the first phase.

18 Claims, 7 Drawing Sheets

OTHER PUBLICATIONS

Frank, et al., "Beam Steering Increments for a Phased Array", IEEE Transactions on Antennas and Propagation, vol. AP-15, Nov. 1967, pp. 820-821.
Hatcher, "Granularity of Beam Positions in Digital Phased Arrays", Proceedings of the IEEE, vol. 56, No. 11, Nov. 1968, pp. 1795-1800.
Jones, et al., "Factors Affecting Beam Granularity and Pointing Accuracy in an Electronically Scanned Phased Array", Proceedings of 18th Annual USAF Antenna R&D Symposium, Oct. 1968, pp. 1-27.
Mailloux, "Array Grating Lobes due to Periodic Phase, Amplitude and Time Delay Quantization", IEEE Transactions on Antennas and Propagation, vol. AP-32, No. 12, Dec. 1984, pp. 1364-1368.
Clenet, et al., "Visualization of Radiation-Pattern Characteristics of Phased Arrays Using Digital Phase Shifters", IEEE Antennas and Propagation Magazine, vol. 45, No. 2, Apr. 2003, pp. 20-35.
Smith, et al., "A Comparison of Methods for Randomizing Phase Quantization Errors in Phased Arrays", IEEE Transactions on Antennas and Propagation, vol. AP-31, No. 6, Nov. 1983, pp. 821-828.
Jiang, et al., "Comparison of Random Phasing Methods for Reducing Beam Pointing Errors in Phased Array", IEEE Transactions on Antennas and Propagation, vol. 51, Issue 4, Apr. 2003, pp. 782-787.
Hansen, et al., "Subarray Quantization Lobe Decollimation", IEEE Tranactions on Antennas and Propagation, vol. 47, Issue 8, Aug. 1999, pp. 1237-1239.
Nelson, "Quantization Sidelobes of a Phased Array with a Triangular Element Arrangement", IEEE Transactions on Antennas and Propagation, vol. 17, Issue 3, May 1969, pp. 363-365.
Goto, et al., "Sidelobe-Reduction Techniques for Phased Arrays Using Digital Phase Shifters", IEEE Tranactions on Antennas and Propagation, vol. 18, Issue 6, Nov. 1970, pp. 769-773.
Mohamed, et al., "Grating Lobe Minimization in Sum and Difference Beam Patterns", IEEE Transactions on Antennas and Propagation Society International Symposium, vol. 1, Jun. 22-27, 2003, pp. 772-775.
Toshev, "Suppression of Phase Quantization Lobes for Large Flat Phased Array Antennas", IEEE Transactions on Antennas and Propagation Society International Symposium, vol. 2, Jun. 22-27, 2003, pp. 488-491.

* cited by examiner

AVERAGE ROW PHASE
0 deg
1 /32 x 45 deg
2 /32 x 45 deg
3 /32 x 45 deg
4 /32 x 45 deg
5 /32 x 45 deg
6 /32 x 45 deg
7 /32 x 45 deg
8 /32 x 45 deg
9 /32 x 45 deg
10 /32 x 45 deg
11 /32 x 45 deg
12 /32 x 45 deg
13 /32 x 45 deg
14 /32 x 45 deg
15 /32 x 45 deg
16 /32 x 45 deg
17 /32 x 45 deg
18 /32 x 45 deg
19 /32 x 45 deg
20 /32 x 45 deg
21 /32 x 45 deg
22 /32 x 45 deg
23 /32 x 45 deg
24 /32 x 45 deg
25 /32 x 45 deg
26 /32 x 45 deg
27 /32 x 45 deg
28 /32 x 45 deg
29 /32 x 45 deg
30 /32 x 45 deg
31 /32 x 45 deg
PHASE SHIFTER
PHASE SHIFTER
[0,0,0]
[0,0,1]
140
140
150
150
160
162
164
170
180
110

TWO DIMENSIONAL QUANTIZATION METHOD FOR ARRAY BEAM SCANNING

GOVERNMENT FUNDING

The U.S. Government may have certain rights in this invention as provided for in the terms of Contract No. N68936-03-C-0038 issued by the Naval Air Warfare Center, Weapons Division (NAWCWD) as part of a Defense Advanced Research Project Agency (DARPA) project.

TECHNICAL FIELD OF THE INVENTION

The present invention relates generally to array antennas, and more particularly, but not by way of limitation, to a two-dimensional quantization method for array beam scanning.

BACKGROUND OF THE INVENTION

Binary digital phase shifters with phase increments of $360°/2^n$ (referred to as "n-bit phase shifters") are commonly used to scan a signal beam of a phased antenna array. Such digital phase shifters typically produce a "stair step" approximation to a desired linear phase gradient. A concern with such "stair step" approximations is that the stair stepping (e.g., jumping from one level to the next) can lead to significant errors in the desired scan angle of the signal beam. If the beam steering controller—the digital circuit that calculates the desired phase shifter settings for each element of the array—calculates high precision phase settings and then rounds the results to match the lower precision of the phase shifters, the beam pointing errors can be as high as the beamwidth/$2^n$. For example, in an array with a 3-bit phase shifter, the error can be as high as one-eighth of a beamwidth.

Another concern is that "stair step" phase gradients that occur with digital phase shifters produce quantization sidelobes in the array patterns. A widely used equation to estimate the level of quantization sidelobes is n*6 dB, where "n" is the number of bits in the phase shifter (e.g., 18 dB for a 3-bit phase shifter.)

To achieve precision beam pointing, some designers have increased the complexity of the array by utilizing 4, 5 or 6 bit phase shifters. Additionally, to reduce aperture errors, several designers have either used or proposed using randomized round off, a control algorithm that involves a pseudo random number generator as a part of the round-off process in the beam steering controller circuits. Such a proportional randomization algorithm, however, is not repeatable. That is, if the same beam pointing command is sent to the beam steering and array repeatedly, each of the aperture phase settings will not be identical. This non-repeatable characteristic complicates checkout and testing of an antenna array.

SUMMARY OF THE INVENTION

According to one embodiment of the invention, a method of increasing a phase resolution of an array antenna, comprises providing an array antenna having a plurality of rows of antenna elements, each antenna element having a first phase resolution; for at least one row of the array antenna, positioning each of the antenna elements to one of first and second phases, the first and second phases separated by at least the first phase resolution; for the at least one row of the array antenna, a number of antenna elements positioned to the first phase is the product of a number of antenna elements in the at least one row of the array antenna and a desired row phase angle divided by the first phase resolution; and for the at least one row of the array antenna, a number of antenna elements positioned to the second phase is the number of elements in the at least one row of the array antenna minus the number of antenna elements in the at least one row positioned to the first phase.

According to another embodiment of the invention, an antenna array includes a plurality of rows of antenna elements. Each antenna element has a first phase resolution. At least one row of the array antenna has each of the antenna elements in the at least one row positioned to one of first and second phases. The first and second phases are separated by at least the first phase resolution. For the at least one row of the array antenna, a number of antenna elements positioned to the first phase is the product of a number of antenna elements in the at least one row of the array antenna and a desired row phase angle divided by the first phase resolution. For the at least one row of the array antenna, a number of antenna elements positioned to the second phase is the number of elements in the at least one row of the array antenna minus the number of antenna elements positioned to the first phase.

Some embodiments of the invention provide numerous technical advantages. A technical advantage of the present invention may include the capability to increase an effective phase resolution of an array antenna. Other technical advantages of the present invention may include the capability to reduce beam-steering errors in an array antenna; the capability to reduce quantization sidelobes in an array antenna; the capability to increase beam pointing performance in an array antenna while maintaining a repeatability of such performance; the capability to reduce complexity and/or costs of the phase shifters in an array antenna while increasing performance; and/or the capability to increase phase control of an array antenna, thereby increasing phase accuracy.

While specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF EXAMPLE EMBODIMENTS OF THE INVENTION

It should be understood at the outset that although example implementations of embodiments of the invention are illustrated below, the present invention may be implemented using any number of techniques, whether currently known or in existence. The present invention should in no way be limited to the example implementations, drawings, and techniques illustrated below. Additionally, the drawings are not necessarily drawn to scale.

Figure 1:
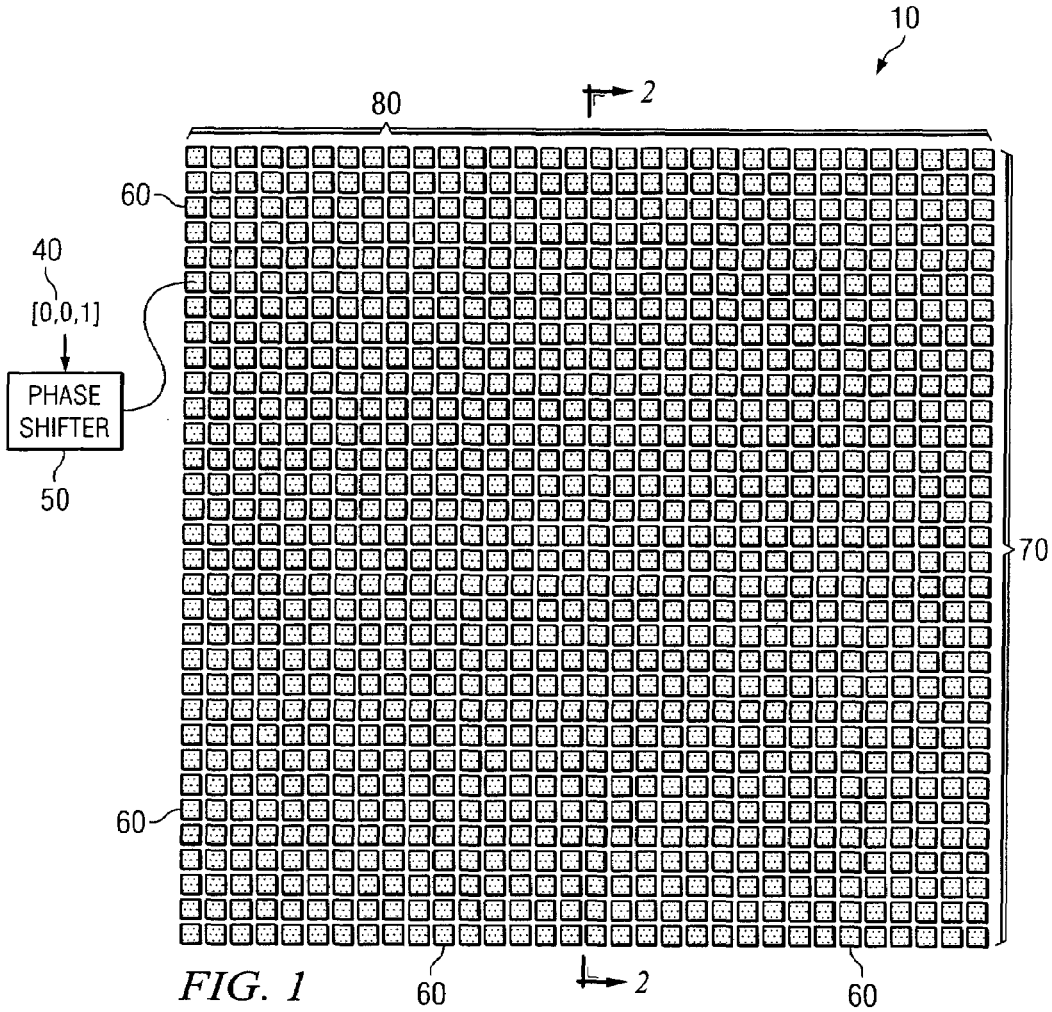
FIG. 1 is a schematic, top view drawing showing a general configuration of an antenna array that can be utilized according to an embodiment of the invention.

FIG. 1 is a schematic, top view drawing showing an illustrative example of an antenna array 10. The antenna array 10 of FIG. 1 includes a plurality of elements 60 that are arranged into rows 70 and columns 80. Each of the elements 60 in the antenna array 10 is generally operable to generate a radiated signal. Phase shifters 50 (only one shown in FIG. 1 for purposes of brevity) can be utilized to manipulate the phases of the radiated signals of the elements 60. An antenna array 10, having elements 60 that are radiating signals with different phases, can via constructive/destructive interference produce a signal beam, pointed in a certain direction. The direction of the signal beam is dependent upon differences of the phases of the elements 60 and how the radiation of the elements 60 constructively/destructively force the signal beam to point in a certain direction. Therefore, the signal beam can be steered to a desired direction by simply manipulating the phase shifters 50 to change the phases of the elements 60. Such steering operations should be apparent to one of ordinary skill in the art.

In the illustrative example of FIG. 1, the elements 60 in the antenna array 10 are manipulated with three-bit digital phase shifters 50. Each phase shifter 50 receives a three-bit value 40 corresponding to the desired phase for each element. With three-bit values 40, the phase shifters 50 are capable of manipulating the elements 60 to $2^3$ or eight different states or phases (0°, 45°, 90°, 135°, 180°, 225°, 270°, and 315°). Hence, each element of the antenna array 10 has a phase resolution of 360°/8 or 45°. It will be recognized by one of ordinary skill in the art that in other embodiments higher bit phase shifters 50 can be utilized (e.g., four-bit, five-bit, six-bit, and the like).

Figure 2:
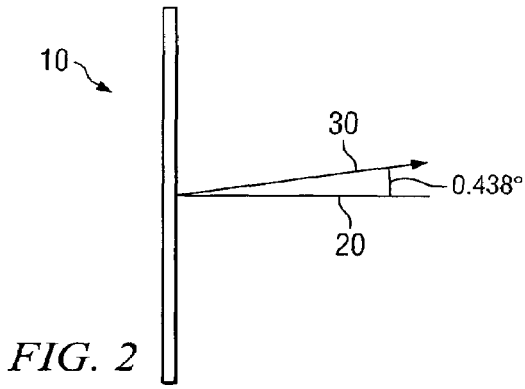
FIG. 2 is a cross section of FIG. 1 cut across line 2-2.

FIG. 2 is a cross section, cut across lines 2-2 of FIG. 1. With reference to FIGS. 1 and 2, the following is an illustrative example of a beam steering operation. The direction of the signal beam can typically be represented in terms of vertical and horizontal angles from a boresight 20 (a direction that is generally perpendicular to the plane of the antenna array 10). In order for the antenna array 10 to produce a signal beam that is directed at a vertical steering angle—for example, the direction of the arrow 30 of FIG. 2—from the boresight 20, the antenna array 10 needs an appropriate phase gradient across the rows 70. The determination of the appropriate phase gradient needed to produce a desired steering angle is well known to those of skill in the art. In this example, the desired steering angle is 0.438 vertical degrees (direction of the arrow 30 of FIG. 2) from the boresight 20. Therefore, the ideal vertical phase gradient is 1.40625° per row 70. Accordingly, each row 70 would desirably have a phase angle of 1.40625°*(N−1), where N is the number of the row 70. The first (or top) row 70 has a desired phase angle of 0°; the second row 70 has a desired phase angle of 1.40625°, and the third row 70 has a desired phase angle of 2.8125°. The last (or bottom) row 70 would have a desired phase angle of 43.594°.

Effecting the above desired phase angles according to conventional techniques is problematic. For example, utilizing three-bit phase shifters 50, a beam steering controller with a simple phase truncation scheme can only manipulate entire rows 70 to one of eight values: 0°, 45°, 90°, 135°, 180°, 225°, 270°, and 315°. Therefore, each row 70 in the antenna array 10 would have a 0° phase setting because each of the calculated values fall below 45°. Accordingly, the signal beam would be pointed to boresight 20 (straight ahead) and the pointing error would be 0.438°, which is the difference between the desired signal beam direction (the arrow 30 of FIG. 2) and the actual angle of the signal beam (the direction of the boresight 20 of FIG. 2). It would therefore be desirable to increase an effective phase resolution for an n-bit phase shifter design without increasing the number of bits utilized in phase shifters 50.

Figure 3:
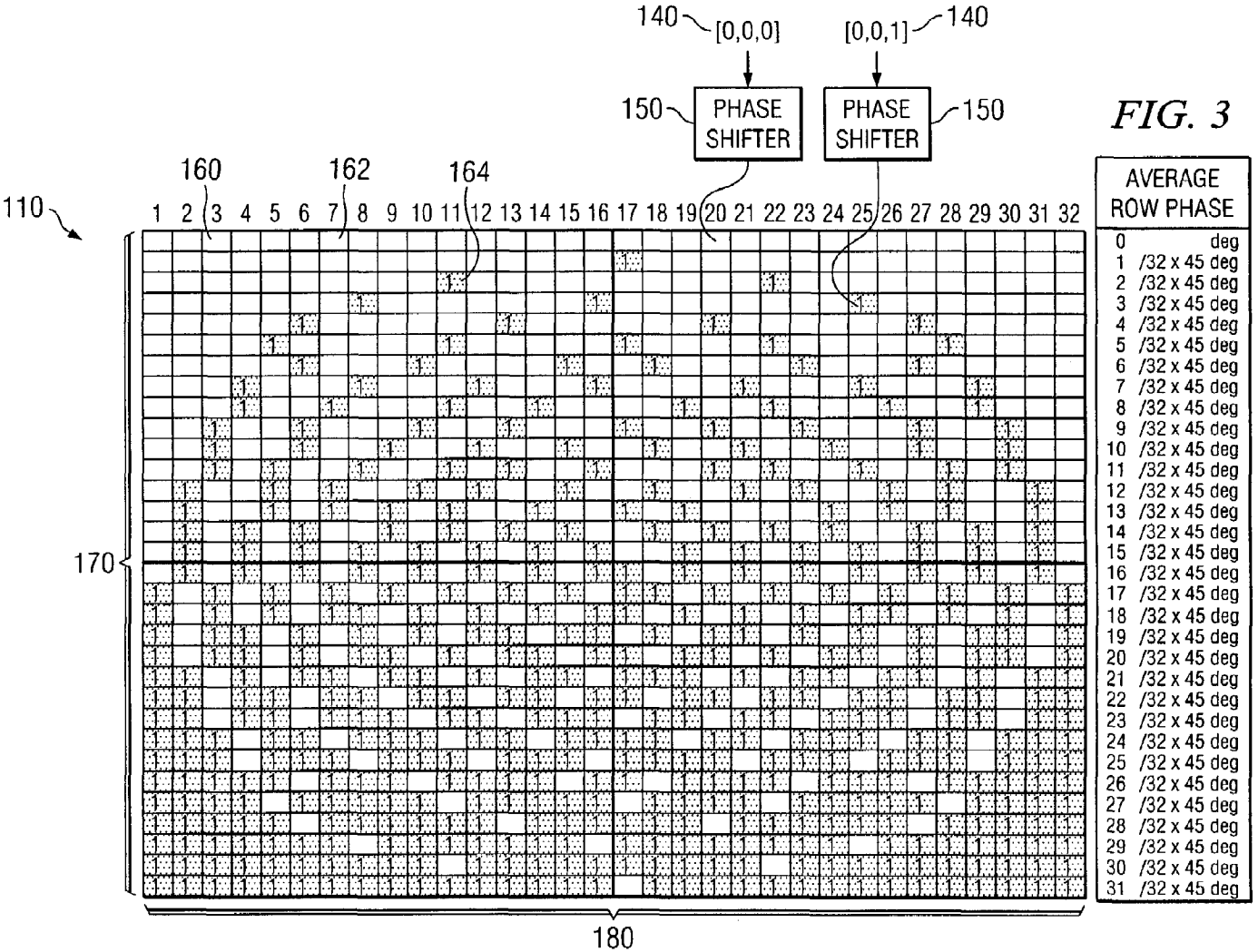
FIG. 3 is a schematic, top view drawing showing manipulation of an antenna array according to an embodiment of the invention.

An approach for addressing the above problem is discussed below with reference to FIGS. 3 and 4. FIG. 3 is a schematic, top view drawing showing manipulation of an antenna array 110, according to the teachings of an embodiment of the invention. In this embodiment, an "effective" phase resolution of an antenna array 110 is created to approximate the above ideal phase gradient. In general, the effective phase resolution is created by individually manipulating elements 160 in a row 170. Individual manipulation allows the row 170 to have a combination of elements 160 with different phases as opposed to a row 170 of elements 160 with all the same phase. A row 170 with elements 160 of differing phases will produce an average of phases that can be utilized as a phase angle for a particular row 170. As an example, the top or first row 170 of the antenna array 110 of FIG. 3 has all its elements 160 set to 0°, indicated by the white blocks 162. The second row 170 has one element 160 set to 45°, indicated by the shaded block 164. The third row 170 has two elements 160 set to 45° and so on. The average phase for the second row 170 is (1/32)*45° or 1.40625° and the average phase for the third row 170 is (2/32)*45° or 2.8125°. These average phases are the ideal or desired phase angles for each respective row 170. The process continues until the bottom row 170 of the array 110 has all but one element 160 set to 45°, which produces a phase of (31/32)*45° or 43.594°, the ideal or desired phase angle for the last row 170.

Thus, an effective phase angle for each row has been created by manipulating certain elements 160 in each row to a phase of 0° and manipulating certain elements 160 in each row to a phase of 45° with the average of the phases being the effective phase angle for each row. Generally, the phase shifters 150 can receive a three-bit value 140 of [0,0,0] to manipulate an element 160 to a phase of 0° (indicated by white blocks 162) and a three bit value of [0,0,1] to manipulate an element 160 to a phase of 45° (indicate by shaded blocks 164). It will be recognized by one of ordinary skill in the art that other bit values can be utilized for other phase settings.

By using an extra degree of freedom afforded by an independent phase manipulation of elements in a row 170 as opposed to setting all the elements 160 in the same row 170 to the same phase, an effective phase gradient can be established which much more closely matches the ideal phase gradient. The accuracy will depend on the number of elements 160 in a particular row. In the example above, the use of 32 elements 160 in a row 170 provides an "effective" resolution for each row 170 of (1/32)*45° or 1.40625°. Therefore, the method in this embodiment has converted a 3-bit phase shifter (e.g., having $2^3$ or 8 phases) to an effective 8-bit phase shifter (e.g., having $2^8$ or 256 "effective" phases). The above-described method may be utilized for any suitable desired beam steering angle.

While the above method has been described with reference to manipulating the scan beam in the vertical direction (manipulating elements 160 in a row 170), it should also be understood that the same process may be utilized for scanning the beam horizontally (manipulating elements 160 in a column 180). In a configuration where the array 100 includes vertical and horizontal steering components (Kx and Ky), the method may be followed independently in each of the two steering directions to determine the settings for the phase shifters 150 and corresponding elements 160 in each steering direction. Then, the results for each can be added together, element by element.

The above example of FIG. 3 gives a configuration where the successive rows 170 are incremented by a single element 160. Therefore, the configuration of the antenna array 110 of FIG. 3 can serve as a map or table for selecting which elements 160 to increment or advance to the next successive phase setting or level and which elements 160 to leave at the current phase setting or level.

The elements 160 in each row 170 of FIG. 3 are generally uniformly distributed across the entire row 170, and are generally symmetrical abut the center of the antenna array 110. Such a pattern minimizes effects on the beam scan angle and beam shape in the orthogonal (or cross-plane) direction. The pattern of FIG. 3 is particularly effective for arrays or sections of arrays that have rows with less than 32 elements 160.

While the manipulation pattern of FIG. 3 is shown, it should be understood that other patterns can be utilized as will become apparent to one of ordinary skill the art. Additionally, while a specific configuration has been shown above with reference to the above-described method, it should be understood that the above-described method may be utilized with other antenna array configurations. For example, the method may be utilized on antenna arrays configurations that have larger or smaller numbers of rows and columns. Additionally, the method may be utilized on array configurations that have oval, circular, or other rectangular shapes and/or non-planar surfaces. Furthermore, the method may be utilized on array configurations that are not powers of two, that are not square, and that are amplitude tapered. Further, while the elements are arranged in rows and columns in these embodiments, in other embodiments, the elements may be arranged in other manners.

Figure 4A:
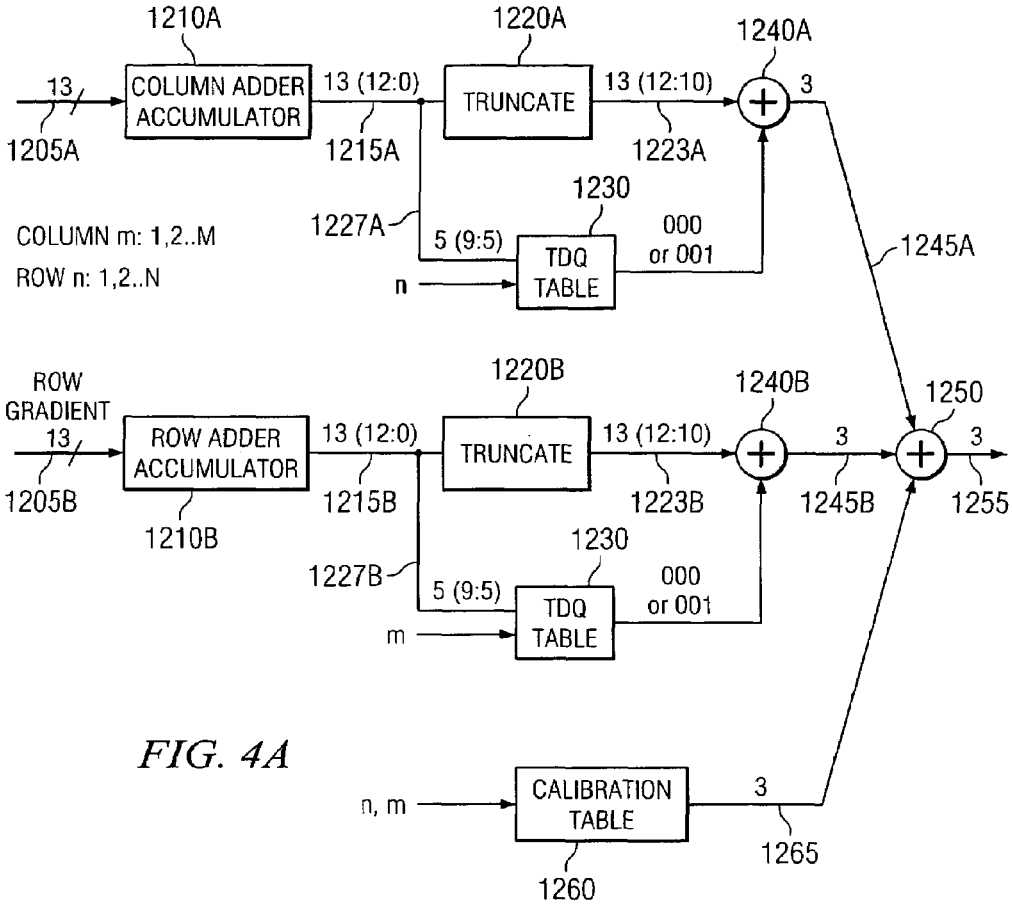
FIG. 4A is a block diagram illustrating a process that can be utilized to manipulate an antenna array.

FIG. 4A is a block diagram illustrating a process that can be utilized to manipulate an antenna array. In general, steering of a signal beam on an antenna array to a desired direction (horizontal and vertical angles from boresight) involves calculating a row (vertical) phase gradient and a column (horizontal) phase gradient for the elements on the antenna array. Such phase gradient calculations are within the knowledge of those skilled in the art and therefore, for purposes of brevity, will not be described.

The process of FIG. 4A takes these phase gradient settings and processes them to set the individual phase of elements in the antenna array in a manner that allows an approximation of the desired phase gradients. The illustrative example of FIG. 4A utilizes three-bit digital phase shifters that allow the elements to be positioned in one of eight phase states. The following is a general illustration of a vertical (row) manipulation of the phases of the elements.

The beam steering controller receives an eight-bit input that represent the desired row gradient. The first three bits are initial or base phase setting bits that set all the elements in each row to an initial phase setting. For example, all the elements in a particular row could initially be set to a phase of 0°. The remaining five bits (remainder bits) represent the elements in the row that will be incremented to the next phase setting. In other words, with reference to the above example with an initial phases setting of 0°, the remainder bits represent which elements will be incremented to a phase of 45°. If the antenna array has 32 elements in the row, then the five remainder bits represent an address, which when cross referenced with a look-up table (e.g., a table similar to the configuration of the array/table in FIG. 3) selects which elements in the row get incremented to the next phase setting. A similar process may be utilized for the horizontal (column) manipulation. The below description provides further detail of one implementation of the above generally described process.

With reference to the blocks of FIG. 4A, a precision column gradient 1205A is fed into a column adder/accumulator 1210A as a thirteen-bit word. The first eight bits are those described above while the extra five bits, described in more detail below, are utilized for error control. The column adder/accumulator 1210A can repeatedly add the gradient to itself to create a sequence of values one, two, three, etc., times the column gradient. This repeated addition calculates the thirteen bit phase values for each successive column of the array for each calculation cycle. Overflow bits created by this repeated addition process can be discarded because they represent phase values greater than 360°. Discarding the overflow bits is simply the modulo-360° operation used in phase steered arrays.

An output 1215A of the column adder/accumulator 1210A (labeled in FIG. 3 as bits 12:0) is processed by a truncator 1220A, which parses the output 1215A into two parts: the base phase setting bits 1223A (the three most significant bits—labeled in FIG. 4A as bits 12:10) and the remainder bits 1227A (the next five bits—labeled in FIG. 3 as bits 9:5). The base phase setting bits 1223A are the initial or base phase setting for the phase shifter. The remainder bits 1227A are used as a location address, which can cross-reference a table 1230. For a given five-bit address in the table 1230 along with the corresponding element address, the particular state of an element can be determined. If the addressed position is a 1 (shaded in FIG. 3) a "001" binary value is fed into the round up adder 1240A. If the addressed position is a 0 (white in FIG. 3) a "000" binary value is fed into the round-up adder 1240A. The round up adder 1240A can increment the initial (or base) phase setting by 1, depending on the value in the table 1230. Overflow or modulo-360° may occur in the round up adder 1240A. The additional bits in positions 4:0 (not shown) can be utilized to prevent errors from accumulating in the fifth bit during the repeated operations of the column adder/accumulator 1210A. These additional bits can be truncated (e.g., by the truncator 1220A) without loss of accuracy in the process.

The processing of the rows on the antenna array operates in a similar manner to the above described processing of the columns. For example, a precision row gradient 1205B is fed into a row adder/accumulator 1210B as a 13-bit word. An output 1215B of the row adder/accumulator 1210B (labeled in FIG. 3 as bits 12:0) is processed by a truncator 1220B, which parses the output 1215B into two parts: the base phase setting bits 223B (the three most significant bits—labeled in FIG. 3 as bits 12:10) and the remainder bits 1227B (the next five bits—labeled in FIG. 3 as bits 9:5). The same table 1230 utilized in the column processing can be utilized in the row processing. The five-bit address provided by the remainder bits 1227B and the corresponding element address can be cross-referenced with the table 1230. If the addressed position is a 1 (shaded in FIG. 3) a "001" binary value is fed into the round up adder 1240B. If the addressed position is a 0 (white in FIG. 3) a "000" binary value is fed into the round-up adder 240B.

The three-bit results 1245A of the column and the three-bit result 1245B of the row are added in a column-row calibration adder 1250. As this block diagram shows, a three-bit calibration value 1265 may also be added to the column-row calibration adder 1250—the calibration value 1265 determined from a calibration table 1260. Calibration tables are commonly used to correct for phase errors produced by hardware tolerances in arrays and should become apparent to one of ordinary skill in the art. The calibration table 1260 in this configuration receives input from addresses of "m" and "n", described above. Other calibration techniques and/or configurations can be utilized as will become apparent to one of ordinary skill in the art. The output 1255 of the column-row calibration adder 1250 is the three-bit value fed to a phase shifter to manipulate a specific element.

While the table 1230 has been described as corresponding to a table similar to that of FIG. 3, it should be understood that other tables can be utilized. For example, the table 1230 could have a circular, rectangular, or elliptical array. Additionally, the table may simply be values stored in a memory unit. To a certain degree, the pattern or dispersion of the table 1230 will depend on the number of elements, shape of the antenna array and/or the desired operation of the antenna array.

Other implementations of the above-described method, including a variety of hardware and/or software configurations, will become apparent to one of ordinary skill in the art—such implementations including not only those that are now known, but also those that will be later developed.

Figure 4B:
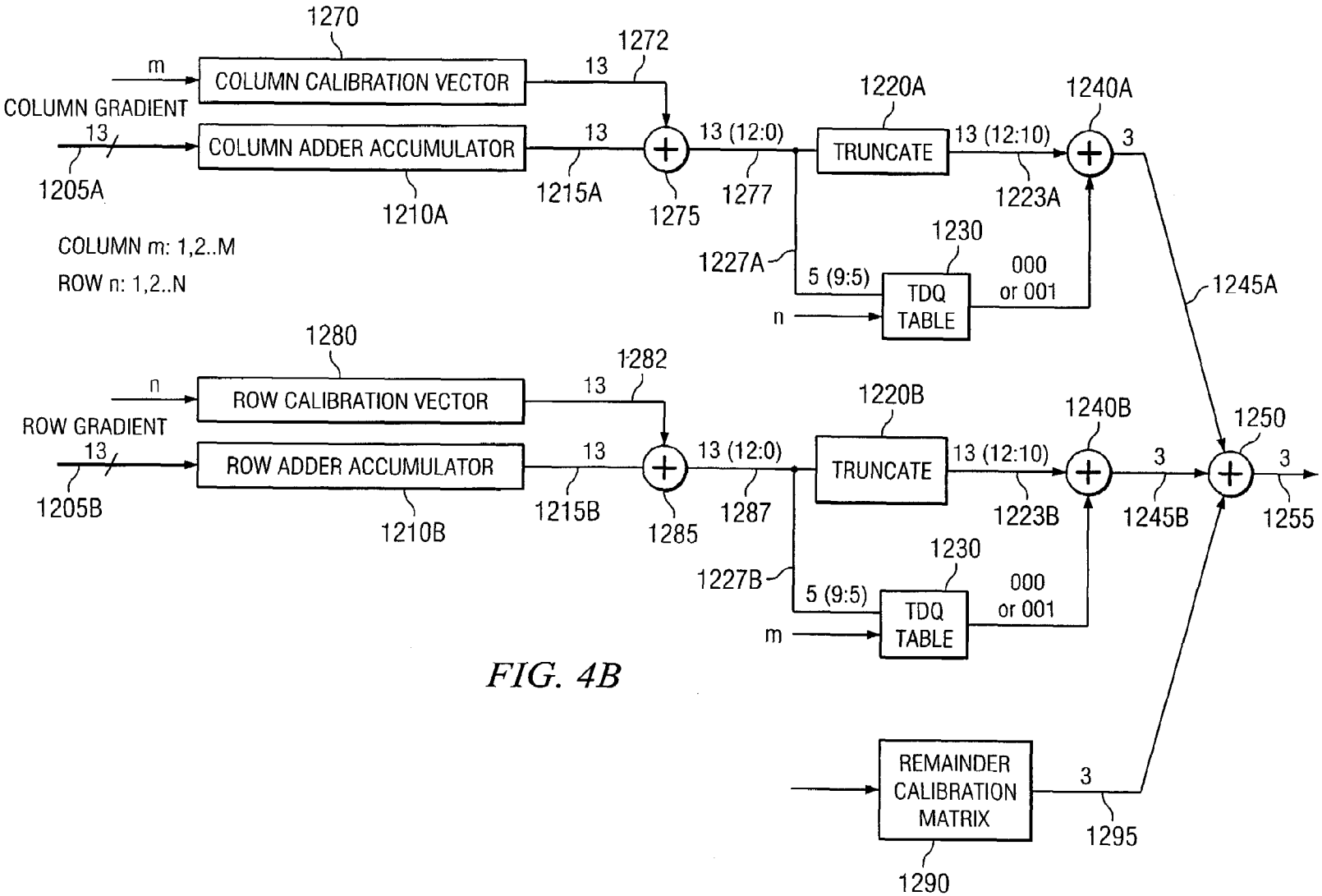
FIG. 4B is another block diagram illustrating another process that can be utilized to manipulate an antenna array.

FIG. 4B is another block diagram illustrating another process that can be utilized to manipulate an antenna array. The process of FIG. 4B operates in a similar manner to the process of FIG. 4A, except that the process of FIG. 4B integrates additional calibration data. Errors that arise from construction tolerances in row and column feed networks are generally correlated along the rows and/or the columns. Therefore, these errors can be corrected during the row/column processing.

Given an M×N matrix/array, and letting $\phi_{m,n}$ represent a measured correction phase for element m,n (where m and n represent a position in the row and column of the matrix/array), a row calibration vector 1280 can be expressed as:

$$\Phi_{Row_n} = \frac{\sum_{m=1}^{M} \varphi_{m,n}}{M}$$

Similarly, a column calibration vector 1270 can be expressed as:

$$\Phi_{Col_m} = \frac{\sum_{n=1}^{N} \varphi_{m,n}}{N}$$

The calibration vectors, 1270, 1280 are incorporated into the column/row processing as follows. A value 1282 from the row calibration vector 1280 is added to the output 1215B from the row adder accumulator 1210B in an column calibration adder 1285. Then, the output 1287 of the column calibration adder 1285 is fed into the truncator 1220B and processed in a similar manner to that described in FIG. 4A. Overflow can occur in the column calibration adder 1285, which is simply the effect of a modulo-360 mathematical operation.

Similarly, a value 1272 from the column calibration vector 1270 is added to the output 1215A from the column adder accumulator 1210A in a column calibration adder 1275. Then, the output 1277 of the row calibration adder 1275 is fed into the truncator 1220A and processed in a similar manner to that described in FIG. 4A. Overflow can occur in the row calibration adder 1275.

In the calculation of the row calibration vector 1280, errors across the columns and uncorrelated errors are averaged out, leaving a residual phase term that applies to the entire row. Similarly, in the calculation of the column calibration vector 1270, errors across the rows and uncorrelated errors are averaged out, leaving a residual phase term that applies to the entire column. Therefore, a remainder matrix 1290 can be calculated to remove these correlated errors from the array calibration data and to determine a remainder of un-correlated errors. The remainder matrix 1290 can be represented as:

$$\phi_{remainder_{m,n}} = \phi_{m,n} - (\Phi_{Row_n} + \Phi_{Col_m})$$

The value 1295 from the remainder matrix 1290 is added in the column row calibration adder 1250 along to the three-bit result 1245A of the column and the three-bit result 1245B of the row.

It will be recognized by one of ordinary skill in the art that the processing of the overall calibration matrix for the array into row, column and remainder parts can occur in an "automatic" fashion and does not require prior knowledge of row or column correlated errors.

Figure 5A:
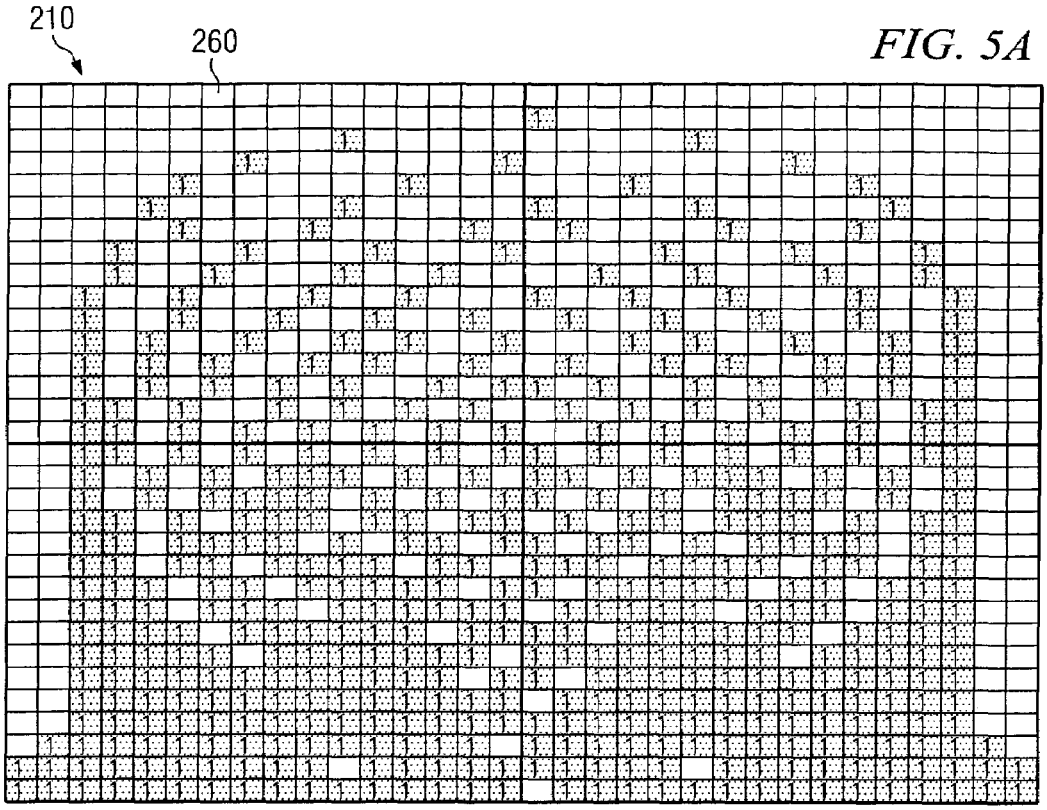
FIG. 5A is another schematic, top view drawing showing a manipulation of an antenna array according to another embodiment of the invention.
Figure 5B:
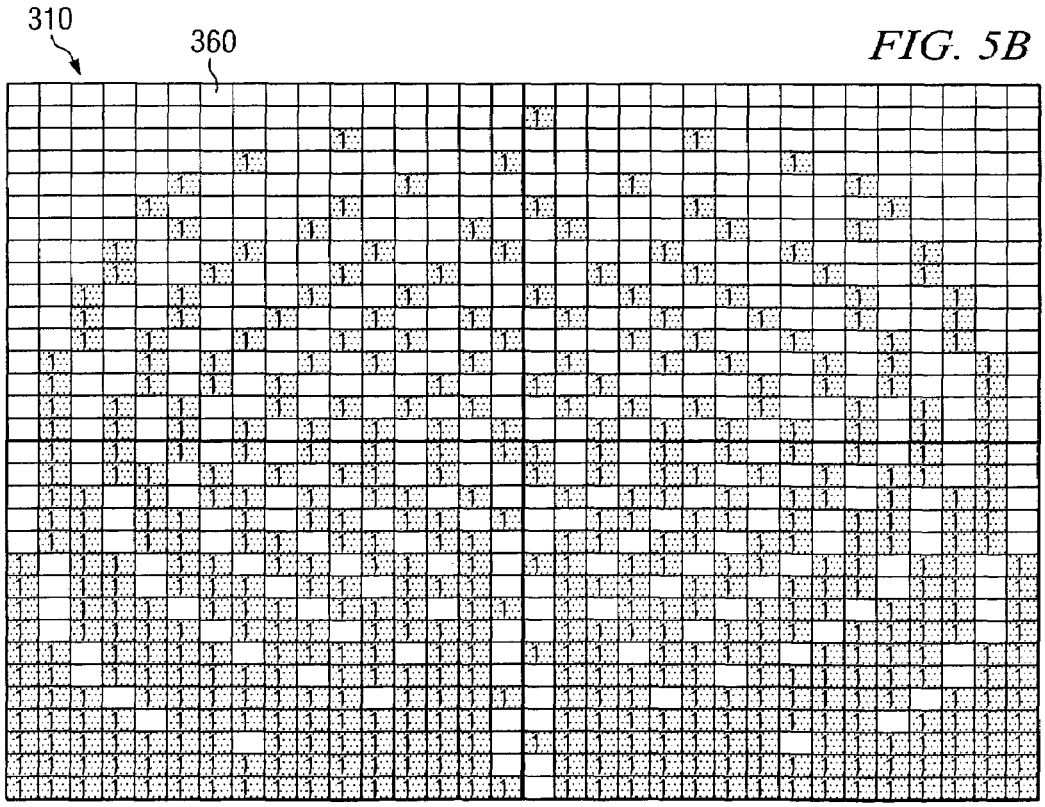
FIG. 5B is a yet another schematic, top view drawing showing a manipulation of an array according to yet another embodiment of the invention.

FIGS. 5A and 5B are illustrative of other manipulation patterns for antenna arrays 210, 310 that can be utilized, according to embodiments of the invention. Such manipulation patterns may lead to better performance for an array with amplitude taper or with an array that is truncated from a square shape to approximate a circular shape. The patterns of FIGS. 5A and 5B show 32 by 32 arrays 210, 310 that have been truncated to 672 elements 260, 360 to approximate a circular shape. For an array with an amplitude taper, evaluation of various tables can be performed to select a specific table for implementation. In general, the manipulation patterns of FIGS. 3, 5A, and 5B, are uniformly and symmetrically distribute the elements 160, 260, and 360. Such a uniform and symmetrical distribution facilitates in some embodiments the horizontal and vertical steering of the signal beam.

Figure 6A:
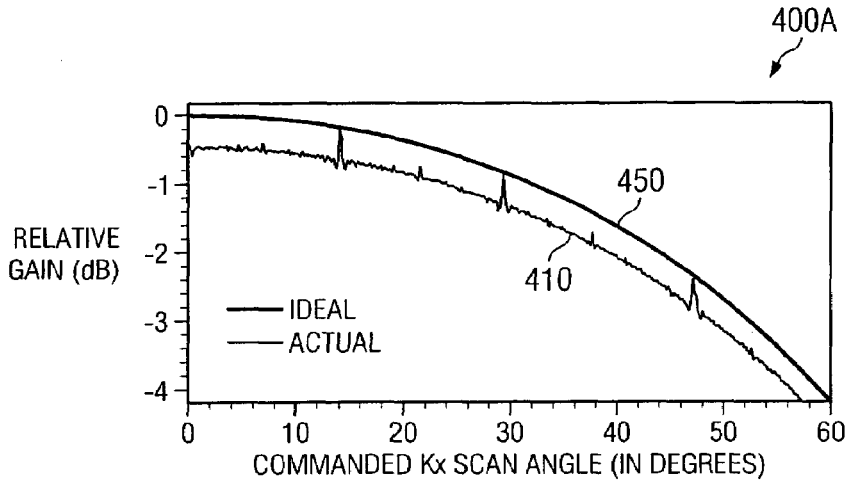
FIGS. 6A, 6B, and 6C are various graphs plotting a scan angle versus a relative gain for various embodiments of the invention.
Figure 6B:
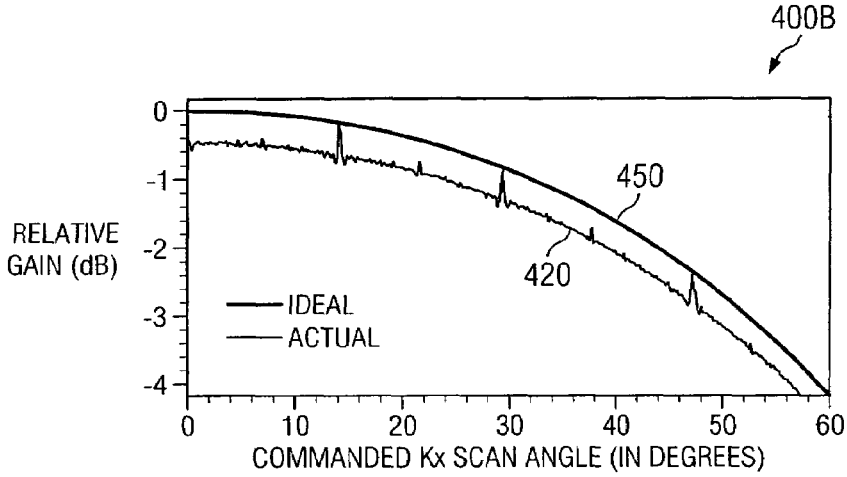
Figure 6C:
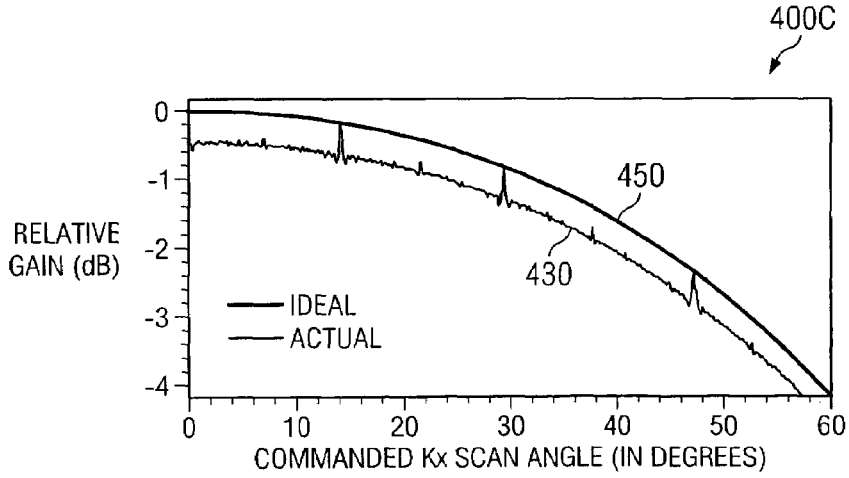

FIGS. 6A, 6B, and 6C show plots 400A, 400B, and 400C of the peak-of-beam directive gain degradation compared to an ideal array with analog phase shifters for each of three different array patterns. Plot 400A corresponds to the pattern of FIG. 3; Plot 400B corresponds to the pattern of FIG. 5A; and Plot 400C corresponds to the pattern of FIG. 5B. It can be seen that for each plot, the actual values 410, 420, and 430 for the "Scan Angle" measured against the "Relative Gain" closely approximates the ideal values 450 for the "Scan Angle" measured against the "Relative Gain".

Figure 7A:
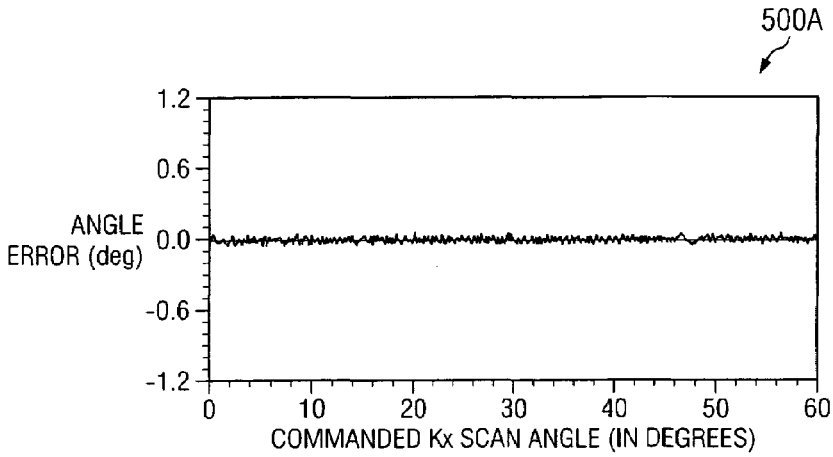
FIGS. 7A, 7B, and 7C are various graphs plotting a beam steering error versus a command scan angle for various embodiments of the invention.
Figure 7B:
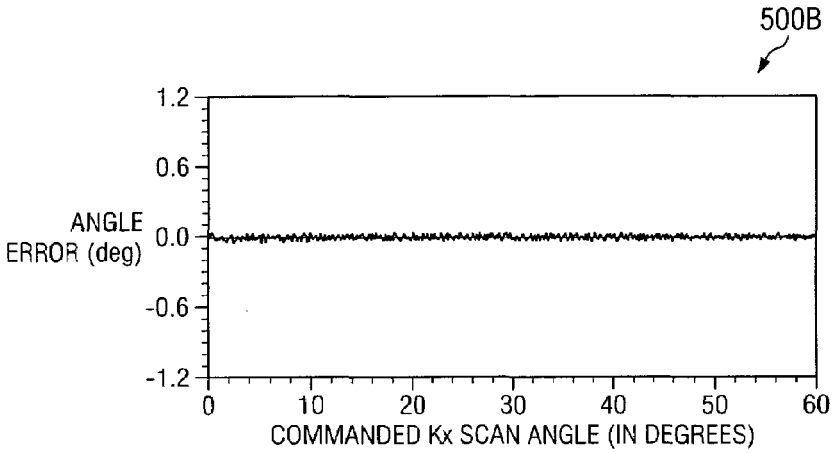
Figure 7C:
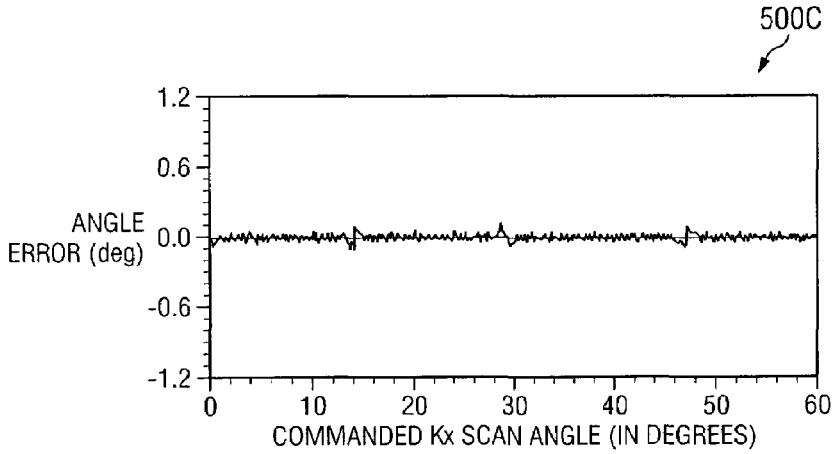

FIGS. 7A, 7B, and 7C show plots 500A, 500B, and 500C of a beam steering error versus a command scan angle (Kx) for each of three different array patterns. Plot 500A corresponds to the pattern of FIG. 3; Plot 500B corresponds to the pattern of FIG. 5A; and Plot 500C corresponds to the pattern of FIG. 5B. It can be seen that for each plot 500A, 500B, and 500C that the beam steering error is approximately less than 0.1 angular degrees at every command scan angle between 0 and 60 degrees.

Thus, it is apparent that there has been provided, in accordance with the present invention, a two-dimensional quantization method for array beam scanning that satisfies one or more of the advantages set forth above. Although the present invention has been described with several embodiments, a myriad of changes, variations, alterations, transformations, and modifications may be suggested to one skilled in the art, even if all of the advantages and benefits identified above are not present. For example, the various elements or components may be combined or integrated in another system or certain features may not be implemented. Also, the techniques, systems, sub-systems, compositions and methods described and illustrated in the embodiment as discrete or separate may be combined or integrated with other systems, techniques, or methods without departing from the scope of the present invention. Other examples of changes, substitutions, and alterations are readily ascertainable by one skilled in the art and could be made without departing from the spirit and scope of the present invention as defined by the appended claims.

What is claimed is:

1. A method of increasing a phase resolution of an array antenna, the method comprising:

providing an array antenna having a plurality of rows of antenna elements, each antenna element having a first phase resolution and emitting a signal; and for at least one row of the array antenna, manipulating the signal of each of the antenna elements to one of first and second phases, the first and second phases separated by at least the first phase resolution, wherein:

for the at least one row of the array antenna, a number of antenna elements with signals manipulated to the first phase is the product of a number of antenna elements in the at least one row of the array antenna and a desired row phase angle divided by the first phase resolution, and for the at least one row of the array antenna, a number of antenna elements with signals manipulated to the second phase is the number of elements in the at least one row of the array antenna minus the number of antenna elements with signals manipulated to the first phase in the at least one row.

2. The method of claim 1, wherein the number of antenna elements manipulated to the first phase in the at least one row are approximately uniformly distributed across the at least one row and approximately distributed symmetrically about a center of the at least one row.

3. The method of claim 1, further comprising:

selecting a phase gradient across the rows, the phase gradient across the rows defining the desired row phase angle for each row; and for each row, manipulating the signal of each of the antenna elements to one of the first and second phases, wherein the number of antenna elements with signals manipulated to the first and second phases is selected such that the average of phases for each row approximates the desired row phase angle for each row.

4. The method of claim 1, wherein the array antenna includes at least one column, further comprising:

manipulating the signal of each of the antenna elements of the at least one column to one of first and second phases, the first and second phases separated by at least the first phase resolution, wherein:

for the at least one column of the array antenna, a number of antenna elements with signals manipulated to the first phase is the product of a number of antenna elements in the at least one column of the array antenna and a desired column phase angle divided by the first phase resolution; and for the at least one column of the array antenna, a number of antenna elements with signals manipulated to the second phase is the number of elements in the at least one column of the array antenna minus the number of antenna elements with signals manipulated to the first phase in the at least one column.

5. The method of claim 4, wherein the array antenna includes a plurality of columns, further comprising:

selecting a phase gradient across the columns, the phase gradient across the columns defining the desired column phase angle for each column; and for each column, manipulating the signal of each of the antenna elements to one of the first and second phases, wherein the number of elements manipulated to the first and second phases is selected such that the average of phases for each column approximates the desired column phase angle for each column.

6. The method of claim 1, wherein the first phase resolution is at least 45 degrees.

7. The method of claim 1, wherein an increased phase resolution for each row is the first phase resolution divided by the number of elements in each row.

8. The method of claim 7, wherein the increased phase resolution for each row is less than 3.0 degrees.

9. The method of claim 7, wherein the increased phase resolution for each row is less than 1.5 degrees.

10. An antenna array, comprising:

a plurality of rows of antenna elements, wherein:

each antenna element has a first phase resolution and emits a signal, at least one row of the array antenna has each of signals in the at least one row manipulated to one of first and second phases, the first and second phases are separated by at least the first phase resolution, for the at least one row of the array antenna, a number of antenna elements with signals manipulated to the first phase is the product of a number of antenna elements in the at least one row of the array antenna and a desired row phase angle divided by the first phase resolution, and for the at least one row of the array antenna, a number of antenna elements with signals manipulated to the second phase is the number of elements in the at least one row of the array antenna minus the number of antenna elements with signals manipulated to the first phase in the at least one row.

11. The antenna array of claim 10, further comprising:

a plurality of digital phase shifters, operable to shift the phases of the signals of each element, wherein:

each of the plurality of digital phase shifters receives a number of bits that define a phase setting of a signal for the elements; and an effective phase resolution for each element of the antenna array is less than $360/2^N$, where N is the number of bits that define the phase setting.

12. The antenna array of claim 10, further comprising:

a phase gradient across the rows, wherein:

the phase gradient across the rows define a desired row phase angle for each row;

each row has the signal of each of the antenna elements manipulated to one of the first and second phases; and the number of antenna elements with signals manipulated to the first and second phases is selected such that the average of phases for each row approximates the desired row phase angle for each row.

13. The antenna array of claim 10, further comprising:

at least one column of antenna elements, wherein each of the signals of the antenna elements in the at least one column is manipulated to one of first and second phases, for the at least one column of the array antenna, a number of antenna elements with signals manipulated to the first phase is the product of a number of antenna elements in the at least one column of the array antenna and a desired column phase angle divided by the first phase resolution, and for the at least one column of the array antenna, a number of antenna elements with signals manipulated to the second phase is the number of elements in the at least one column of the array antenna minus the number of antenna elements with signals manipulated to the first phase in the at least one column.

14. The antenna array of claim 12, further comprising:

a plurality of columns of antenna elements; and a phase gradient across the columns, wherein:

the phase gradient across the columns defines a desired column phase angle for each column;

each column has the signal of each of the antenna elements positioned to one of the first and second phases; and the number of elements manipulated to the first and second phases is selected such that the average of phases for each column approximates the desired column phase angle for each column.

15. The antenna array of claim 10, wherein the first phase resolution is at least 45 degrees.

16. The antenna array of claim 10, wherein an increased phase resolution for each row is the first phase resolution divided by the number of elements in each row.

17. The antenna array of claim 16, wherein the increased phase resolution for each row is less than 3.0 degrees.

18. The antenna array of claim 16, wherein the increased phase resolution for each row is less than 1.5 degrees.

* * * * *